US009440264B2

(12) United States Patent
Carpenter et al.

(10) Patent No.: US 9,440,264 B2
(45) Date of Patent: Sep. 13, 2016

(54) METHOD AND SYSTEM FOR WEIGHING MAIL PIECES

(75) Inventors: Michael D. Carpenter, Arlington, TX (US); Michael O. Norris, Colleyville, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 1247 days.

(21) Appl. No.: 12/269,484

(22) Filed: Nov. 12, 2008

(65) Prior Publication Data

US 2009/0084716 A1 Apr. 2, 2009

Related U.S. Application Data

(63) Continuation-in-part of application No. 11/786,839, filed on Apr. 13, 2007.

(60) Provisional application No. 60/987,502, filed on Nov. 13, 2007.

(51) Int. Cl.
*B07C 5/16* (2006.01)
*B07C 1/10* (2006.01)

(52) U.S. Cl.
CPC *B07C 1/10* (2013.01); *B07C 5/165* (2013.01)

(58) Field of Classification Search
CPC ..... B07C 5/165
USPC ..... 209/65, 34, 63, 47, 48, 45, 97, 102, 209/364, 367, 369; 700/223
See application file for complete search history.

(56) References Cited

U.S. PATENT DOCUMENTS

| | | | | |
|---|---|---|---|---|
| 2,841,275 | A * | 7/1958 | Schwimmer et al. | 206/233 |
| 3,270,938 | A * | 9/1966 | Rhinegold | 229/101 |
| 3,331,498 | A * | 7/1967 | Davies | 206/494 |
| 3,956,778 | A * | 5/1976 | Tanaka | 4/144.1 |
| 5,054,620 | A * | 10/1991 | DeWitt et al. | 209/3.1 |
| 5,240,116 | A * | 8/1993 | Stevens et al. | 209/534 |
| 5,803,249 | A * | 9/1998 | Harsanyi et al. | 206/233 |
| 6,003,677 | A * | 12/1999 | Foley | 209/2 |
| 6,032,517 | A | 3/2000 | Reisig et al. | |
| 6,107,579 | A | 8/2000 | Kinnemann | |
| 6,202,224 | B1 * | 3/2001 | Freeman | 4/144.2 |
| 6,364,156 | B1 * | 4/2002 | Smith et al. | 221/46 |
| 6,445,808 | B1 * | 9/2002 | Lile et al. | 382/101 |
| 6,557,755 | B1 | 5/2003 | Pickering, Jr. et al. | |
| 6,655,683 | B2 | 12/2003 | Engarto et al. | |
| 6,861,592 | B2 | 3/2005 | Gerstenberg et al. | |
| 6,878,896 | B2 | 4/2005 | Braginsky et al. | |
| 7,162,459 | B2 | 1/2007 | Massucci et al. | |
| 2002/0040283 | A1 | 4/2002 | Woods et al. | |
| 2004/0040283 | A1 | 3/2004 | Yasui et al. | |
| 2004/0245158 | A1 | 12/2004 | Redford et al. | |
| 2005/0280833 | A1 | 12/2005 | Dian et al. | |

* cited by examiner

*Primary Examiner* — Stefanos Karmis
*Assistant Examiner* — Michael E Butler

(57) ABSTRACT

A method and system is described for determining the physical weights of flat articles being sorted without actually weighing the articles. Such a method includes the steps of; receiving volume information for individual flat articles from sensors, comparing that resultant data to classifiers stored in computer memory, and assigning a weight value associated to the physical flat article.

20 Claims, 4 Drawing Sheets

METHOD AND SYSTEM FOR WEIGHING MAIL PIECES

This application is a continuation-in-part of Ser. No. 11/786,839, filed Apr. 13, 2007, and claims priority of U.S. provisional application No. 60/987,502, filed Nov. 13, 2007.

FIELD OF THE INVENTION

The invention relates to mail sorting machines and processes of the type currently carried out by the U.S. Postal Service (USPS) and private mailers.

BACKGROUND OF THE INVENTION

For years, postal services around the world have been sorting flat articles using automation equipment. Mail piece weights have typically been determined or validated by scale systems measuring force. A flat article is transported with roller pinch belt technology to an area in the sorting machine equipped with a scale. The flat article leaves the pinch belt control and is transported on the narrow axis of the mail piece onto a bottom conveyer belt. The bottom conveyor belt is integrated with a force compensator which is inductively coupled to a sensor or to a strain gauge type scale. The reaction times of these two technologies have an 15 inherent disadvantage when trying to weigh mail pieces at the speed of today's mail sorting equipment. The scale cannot settle in time to make an accurate measurement before the next mail piece arrives at the scale. Methods to overcome these disadvantages are explained in Kinnemann U.S. Pat. No. 6,107,579, Aug. 22, 2000, and Gerstenberg, et al. U.S. Pat. No. 6,861,592, Mar. 1, 2005, the contents of which are incorporated by reference herein. Splitting the mail path allows larger gaps, giving the scale a longer time to settle.

Massucci U.S. Pat. No. 7,162,459 describes another method to overcome the disadvantage of using a physical apparatus to weigh items at high speed by estimating the weight of the flat article. The Massucci measuring system includes a transport, a first plurality of detectors for measuring the dimensions of the mail piece and a second plurality of detectors for measuring values of other characteristics of the mail piece which are indicative of the presence of non-paper materials in the mail piece as the mail piece is transported. The microprocessor is responsive to the second detectors to determine if non-paper materials are included in the mail piece and, if not, determines the volume from the dimensional measurements and estimates the weight as the product of the volume and a density for paper output an appropriate postage amount to the meter and the mail piece to the printer. It is a purpose of this invention to overcome the inherent disadvantages of Massucci, Kinnemann and Gerstenberg.

It is a purpose of this invention to overcome the inherent disadvantages of Massucci, which makes the assumption that flat articles are made of paper, when in fact today's mail is made up of a variety of substrates. Even Massucci says it would be desirable to add an amount of 10% to the weight estimate to allow for errors in the measurement. It is the intent of this invention to resolve the weight of flat articles by comparing the compiled sensors data of a mail piece to historical classifiers built for the purposes of determining the weight of an object.

SUMMARY OF THE INVENTION

A method and system is described for determining the physical weights of flat articles being sorted without actually weighing the articles. Such a method includes the steps of: receiving volume information for individual flat articles from sensors; and comparing that resultant data to classifiers stored in computer memory to assign a weight value associated to the physical flat article. A "classifier" for purposes of the invention is a database (such as a table) accessed by a computer that relates measured size, volume or other data for the mail piece for a match, or closest, with prior sets of such criteria which have been found by actual weighing to have a weight that is the same or very similar for each item with that physical description. Thus after the database of classifiers commonly encountered with postal mail is developed as described hereafter, then it becomes possible in practice to determine the weight of mail pieces moving on the conveyor of a postal processing machine (such as a sorter) without actually weighing mail pieces in transit. The computer software run by the control system uses inductive reasoning to assign a weight based on past experience with mail pieces that match the size parameters of the mail pieces in question. The ability of the classifiers to identify common irregularities that affect the weight of mail, such as enclosed objects, improves the accuracy of the process. These and other aspects of the invention are described further in the detailed description that follows.

BRIEF DESCRIPTION OF THE DRAWINGS

In the accompanying drawings, where like numerals denote like elements and letters denote multiples of a component.

DETAILED DESCRIPTION

Figure 1:
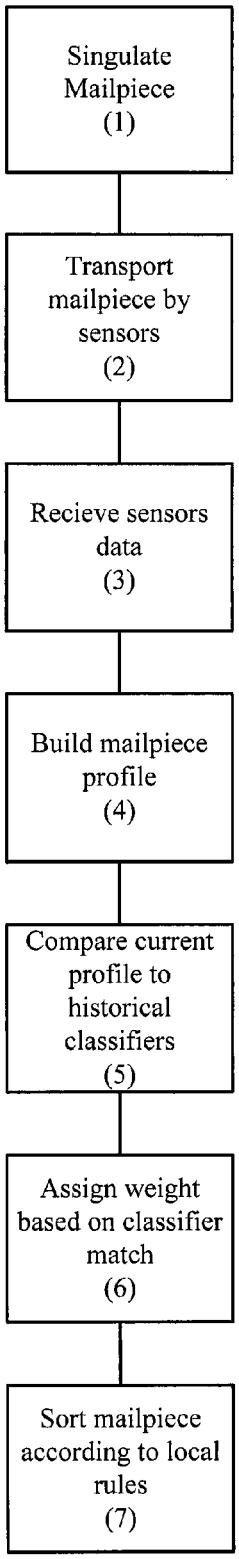
FIG. 1 is a flowchart of a method according to the invention.
Figure 2:
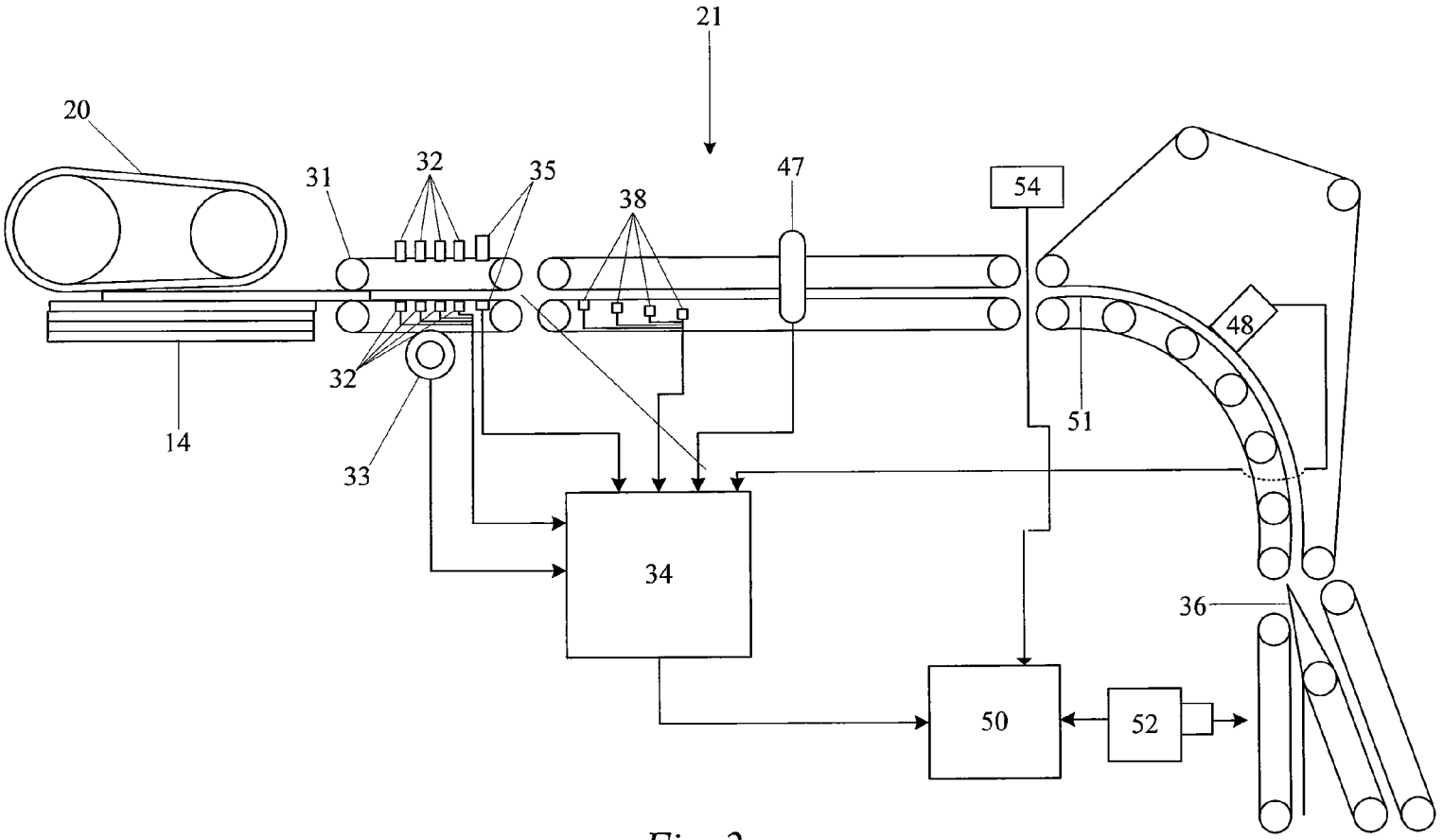
FIG. 2 is a top view of a system according to the invention, with certain components shown schematically.

Referring to FIGS. 1 and 2, in an initial step (1) a mail piece 16 is separated and singulated from a mail stack 14 by the pick off belts of the pickoff 20. In a second step (2), the mail piece 16 is transported by a pinch belt conveyor 15 past a series of light barriers 32 each comprising a photocell receiver element and a light emitter on opposite sides of the conveyor and aligned in parallel to the base plate of the conveyor system 15. Barriers 32 are used to determine the mail length and the gap between successive mail pieces. A tachometer 33 is positioned to monitor the belt speed of the conveyor as the mail passes light barriers 32. In step (3), an analyzer 34 according to the invention, which may be a microprocessor, circuit, or computer, receives a high resolution signal from tachometer 33 and the duration of the block conditions of light barriers (32) to calculate the length of each passing mail piece and the gap between successive mail pieces. Barriers 32 are spaced along the length of the conveyor path as shown so that both length and gap can be determined in a manner known in the art.

Mail pieces that are determined to be too long or which have too small a gap (represent a double with the mail piece ahead of it) are directed out of the machine by a diverter gate 36. A height detection light barrier 35 is provided above the level of the conveyor belts to detect a mail piece that is too tall and therefore must be diverted and handled as manual mail. A vertical row of light barriers 35 or an imaging system can be provided to measure the height of each mail piece.

As the mail piece 16 is transported further downstream in the conveyor path, it passes a series of detection sensors 38. The detection sensors 38 are a series of proximity switches arranged in a matrix 40. The sensors are adjusted and/or spaced to trigger at different depths. As a mail piece 16 passes the sensors, switches are either triggered by the mail piece or not. The analyzer 34 monitors the on-off state of the sensors in the matrix and builds a table for each mail piece in step (4). The table is a grid (mathematical representation) of the thickness profile of each mail piece. Mail pieces which are determined to have a non planar surface indicating there might be an object inserted in the mail piece such as a pen or coin are directed out of the machine by the diverter gate 36. Mail pieces with foreign objects inside are considered non machinable according to postal standards and need to be diverted out of the machine as described in the foregoing Ser. No. 11/786,839, filed Apr. 13, 2007, the contents of which are hereby incorporated by reference herein.

Once all the sensor data has been collected for a single mail piece, and assuming no single attribute has caused the mail piece to be rejected and diverted as described above, the algorithms implemented in analyzer 34 determine if the item can be processed as automation mail or is EC mail which can be sorted on a postal sorting machine with "extended capability", a term used in the postal art to refer to a sorting machine that can handle a wider range of mail piece sizes than conventional letter sorting machines. This information is passed to the machine control 50. "Automation mail" refers to mail which can be scanned and sorted in a conventional MLOCR or DBCS letter sorting machine. Machine control 50 uses the destination information on the face of the item read by an image lift camera 52, or the ID tag on its rear side read by a tag reader (flourescent scanner) 54, along with the determination of whether a piece is automation mail or EC mail, to determine what destination pocket to send the mail piece. Automation mail is segregated from the EC mail.

Next, the mail piece passes a sensor 33 which measures the thickness of the mail piece. Thickness data is generated for locations lying a long a line in the lengthwise direction of the mail piece. The sensor may be one as described in Raoul; et al. U.S. Patent Application 20050280833 Dec. 22, 2005, the contents of which are incorporated by reference herein.

Continuing to travel downstream, the mail piece 6 passes a stiffness detection device, such as described in Reisig U.S. Pat. No. 6,032,517 which is incorporated by reference herein. It is not the intent of the invention to prescribe the order of these events, or to limit the type sensors or to prescribe which technology is used for a particular sensor. In contrast, these technologies are all known to those skilled in the art.

Once all the sensor data has been collected (step 3) for a single mail piece, a computer program builds a mathematical three-dimensional model of the mail piece (step 4). Algorithms compare 15 (5) the current mail piece model to historical models residing in computer memory. (step 5) This may be done by analyzer 34 or control computer 50.

The historical models are built by sampling representative mail pieces at multiple sites (geographic locations) and machines, analyzing the unique features of similar weight items with common attributes and variables, and assigning a group which has common features a common weight value. For example, a number 10 envelope with one sheet of 20 pound paper, folded twice and inserted in an envelope, has 108 mm height, 235 mm, length, 0.75 mm width and has a planar surface. The object will be assigned a weight based on actual weight measurements of other objects meeting the criteria of the classifier. Mail pieces which meet these criteria and have the same attributes are classified as having the weight of 11.3 grams. However the same size envelope with a credit card added would have a non-planar surface wherein the width of the credit card is measured. In this area, representing a 85 mm by 55 mm rectangle within the envelope, the width would be 1.9 mm and the remaining area would have the original 0.75 mm width. The attribute of having a non-planar area the size of a credit card will qualify envelopes with this feature a separate classifier than the original envelope with no credit card. Flat articles which meet this criteria match will be assigned a weight of 30 14.2 grams. It can be shown with historical statistical probability that the envelope with the credit card will have 14.2 grams of weight and the envelope without the credit card will have 11.3 grams weight. The mail piece is thereby assigned a weight based on the classifier match (step 6), and then sorted (step 7) according to the local sort scheme then being implemented by control computer 50. It is assumed that millions of mail pieces will have to be sampled in order to build the classifiers with enough statistical probability to measure weight accurately. The sample volume is dependant on the required accuracy and needed tolerances. As new mail types come into use new profiles will need to be created.

Figure 3:
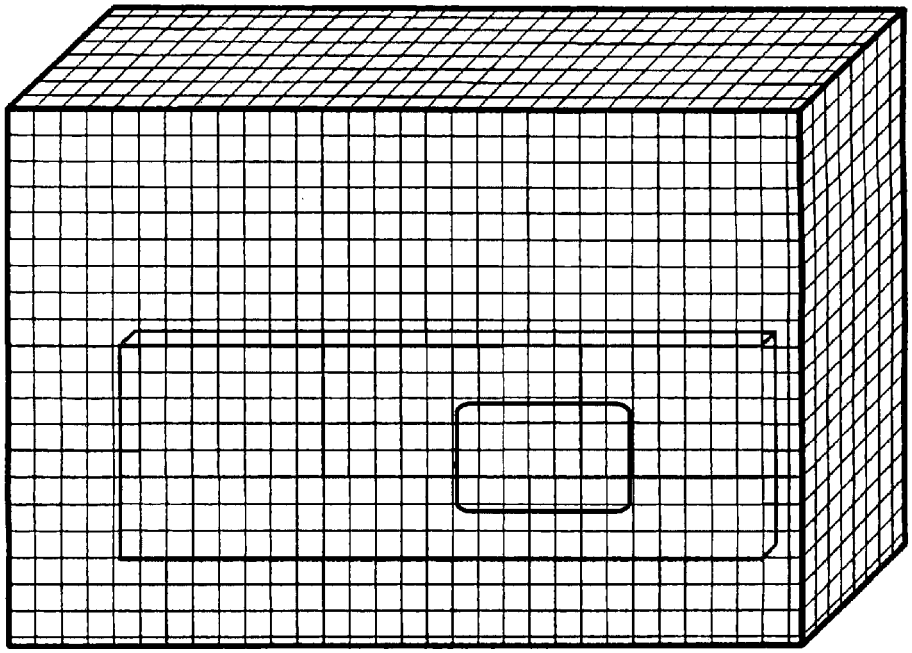
FIG. 3 is a diagram of a mail piece model according to the invention.
Figure 4A:
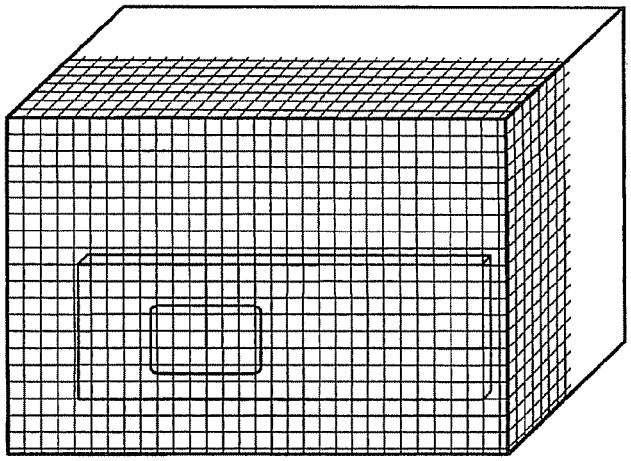
FIGS. 4A, 4B and 4C are diagrams of a series of sample models according to the invention.
Figure 4B:
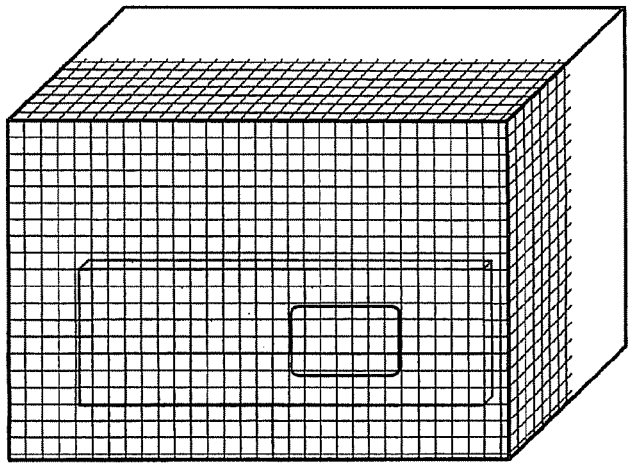
Figure 4C:
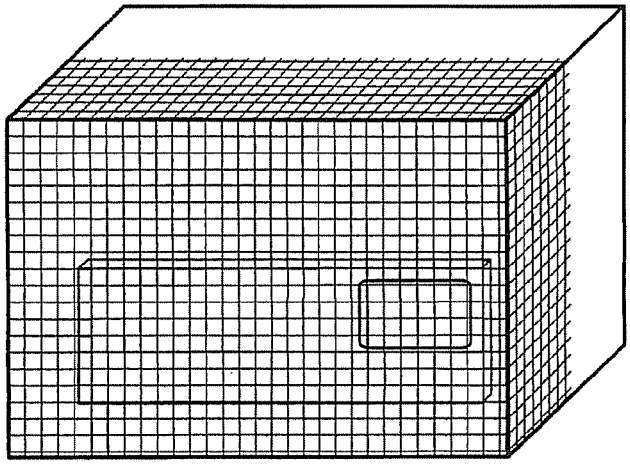

The software builds a mathematical 3-dimensional model as represented by FIG. 3. The software compares the model to the classifiers that where developed from sampling the mail base. Using the example of the number 10 envelope with a sheet of 20 pound paper and a credit card inserted a classifier can be developed. FIGS. 4-6 represent the steps of deriving the classifier where n samples are recorded each meeting the criteria of the classifier. The position of the object (credit card) varies some from one sample to the next, but the classifier might represent a envelope with: Length=235 mm, Height=108 mm, width from 0.75 mm to 2.0 mm, non planar rectangular area on the facial surface measuring 85 mm by 55 mm, width (thickness) of non planar rectangular area: 1.25 to 2.0 mm. The card within the envelope is independent of the derived classifier, that is, it is not necessary to know the identity of the sender. The location of the credit card is also independent of the derived classifier.

The above description describes on implementation of the invention. Other embodiments may have the sensors configured in different order and may include the addition of other sensors not mentioned above to develop classifiers that include additional characteristics, or sensors to detect certain types of. For example, one embodiment might include a sensor which detects ferrous material and develop profiles for mail pieces which contain ferrous objects, assuming they are otherwise machinable (not rejected and diverted at an earlier stage).

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. Such modifications are within the scope of the invention as expressed in the appended claims.

The invention claimed is:

1. A computer implemented method for determining the weights of flat articles being sorted, comprising:

receiving sensor information resulting in data for individual flat articles, which data comprises classifier physical attributes other than weight of the flat articles;

building a mathematical three-dimensional surface model of each flat article based on the data;

comparing each three-dimensional surface model to historical models stored in computer memory;

comparing the data to classifiers stored in the computer memory; and assigning a weight value to each flat article based on classifier matches and the comparison of the three-dimensional models with the historical models.

2. The method of claim 1, wherein the flat articles are mail pieces.

3. The method in claim 1, further comprising building the classifiers by sampling target mail for the purpose of calculating weights, which sampling involves measuring classifier physical attributes of the target mail and weighing the target mail.

4. The method of claim 1, wherein the classifiers comprise ranges of criteria including physical dimensions of a mail piece and raised areas detected on a face of the mail piece.

5. The method of claim 4, wherein the ranges include length, height, width and presence or absence of an area of enhanced thickness of a predetermined shape.

6. The method of claim 1, wherein the sensor information is produced from a plurality of proximity sensors arranged in a matrix.

7. The method of claim 1, wherein the sensor information is produced from a series of detection sensors spaced to trigger at different depths.

8. The method of claim 1, wherein the data includes information from a sensor that detects ferrous materials.

9. The method of claim 1, further comprising building a table of a thickness profile of each flat article based on the sensor information.

10. A computer implemented system for determining the weights of flat articles being sorted, comprising:

a computer;

a computer memory; and a plurality of sensors, wherein the system is configured to receive sensor information from the sensors resulting in data for individual flat articles, which data comprises classifier physical attributes other than weight of the flat articles;

build a mathematical three-dimensional surface model of each flat article based on the data;

compare each three-dimensional surface model to historical models stored in the computer memory;

compare the data to classifiers stored in the computer memory; and assign a weight value to each flat article based on classifier matches and the comparison of the three-dimensional surface models with the historical models.

11. The system of claim 10, wherein the sensors are positioned on a mail sorting machine to generate the sensor data.

12. The system of claim 10, wherein the sensor information is produced from a plurality of proximity sensors arranged in a matrix.

13. The system of claim 10, wherein the sensor information is produced from a series of detection sensors spaced to trigger at different depths.

14. The system of claim 10, wherein the data includes information from a sensor that detects ferrous materials.

15. The system of claim 10, further comprising building a table of a thickness profile of each flat article based on the sensor information.

16. A computer implemented method for determining the weights of flat articles being sorted, comprising:

receiving sensor information resulting in data for individual flat articles;

building a mathematical three-dimensional surface model of each flat article based on the data;

comparing each three-dimensional surface model to historical models stored in computer memory, each historical model having an assigned weight value;

assigning a weight value to each flat article based the comparison.

17. The method of claim 16, wherein the sensor information is produced from a plurality of proximity sensors arranged in a matrix.

18. The method of claim 16, wherein the sensor information is produced from a series of detection sensors spaced to trigger at different depths.

19. The method of claim 16, wherein the data includes information from a sensor that detects ferrous materials.

20. The method of claim 16, further comprising building a grid of a thickness profile of each flat article based on the sensor information.

* * * * *